US010567885B2

(12) United States Patent
Durand et al.

(10) Patent No.: US 10,567,885 B2
(45) Date of Patent: Feb. 18, 2020

(54) ELECTROACOUSTIC TRANSDUCER, AND ASSOCIATED ASSEMBLY AND SYSTEM

(71) Applicants: UNIVERSITE DU MAINE, Le Mans (FR); CENTRE NATIONAL DE LA RECHERCHE SCIENTIFIQUE (CNRS), Paris (FR)

(72) Inventors: Stephane Durand, Pruille le Chetif (FR); Petr Honzik, Prague (CZ); Alexey Podkovskiy, Le Mans (FR); Nicolas Joly, La Chapelle Saint Fray (FR); Michel Bruneau, Le Mans (FR)

(73) Assignees: UNIVERSITE DU MAINE, Le Mans (FR); CENTRE NATIONAL DE LA RECHERCHE SCIENTIFIQUE (CNRS), Paris (FR)

( * ) Notice: Subject to any disclaimer, the term of this patent is extended or adjusted under 35 U.S.C. 154(b) by 142 days.

(21) Appl. No.: 15/521,702

(22) PCT Filed: Oct. 23, 2015

(86) PCT No.: PCT/FR2015/052862
§ 371 (c)(1),
(2) Date: Apr. 25, 2017

(87) PCT Pub. No.: WO2016/066938
PCT Pub. Date: May 6, 2016

(65) Prior Publication Data

US 2017/0245059 A1 Aug. 24, 2017

(30) Foreign Application Priority Data

Oct. 27, 2014 (FR) ..... 14 60325

(51) Int. Cl.
*H04R 19/04* (2006.01)
*H04R 19/00* (2006.01)
(Continued)

(52) U.S. Cl.
CPC ..... *H04R 19/005* (2013.01); *H04R 7/04* (2013.01); *H04R 19/02* (2013.01); *H04R 19/04* (2013.01); *H04R 2201/003* (2013.01)

(58) Field of Classification Search
CPC ..... H04R 7/04; H04R 9/18; H04R 19/005; H04R 19/013; H04R 19/016; H04R 19/02; H04R 19/04; H04R 2201/003
(Continued)

(56) References Cited

U.S. PATENT DOCUMENTS 3,008,013 A * 11/1961 Walker ..... H04R 19/02 381/116
3,778,561 A * 12/1973 Reedyk ..... H04R 19/016 381/113
(Continued)

FOREIGN PATENT DOCUMENTS

DE 10 2012 213310 A1 1/2014
FR 2 673 347 A1 8/1992

OTHER PUBLICATIONS

International Search Report, dated Jan. 20, 2016, from corresponding PCT application.

*Primary Examiner* — Huyen D Le
(74) *Attorney, Agent, or Firm* — Young & Thompson

(57) ABSTRACT

Disclosed is an acoustic transducer for converting a sound signal into an electric signal, including a mobile element movable under the effect of the sound signal, a fixed element opposite the mobile element, a recess, and a dissipative element between the mobile and fixed elements. The coupled system has a natural frequency corresponding to a resonance frequency of the transducer set at maximum sensitivity. The mobile element, the fixed element, the dissipative element and the recess are configured so the quality factor of the acoustic transducer>2. The recess has a straight prismatic, cylindrical, or frustoconical shape, the
(Continued)

mobile element forming a first base of the prism, cylinder, or frustum, the fixed element being inside the prism, cylinder or frustum, over the second base of the prism, cylinder or frustum. Such a transducer also incorporates an analogue filtering function for filtering the signal around the natural frequency of same.

14 Claims, 2 Drawing Sheets

(51) Int. Cl.
*H04R 19/02* (2006.01)
*H04R 7/04* (2006.01)

(58) Field of Classification Search
USPC ..... 381/113, 116, 173, 174, 175, 191
See application file for complete search history.

(56) References Cited

U.S. PATENT DOCUMENTS

| | | | | | |
|---|---|---|---|---|---|
| 4,621,171 | A | * | 11/1986 | Wada | H04R 19/00 381/113 |
| 5,335,286 | A | * | 8/1994 | Carlson | H04R 19/01 381/174 |
| 2003/0128628 | A1 | | 7/2003 | Osborn et al. | |
| 2010/0142325 | A1 | | 6/2010 | Altman et al. | |

* cited by examiner

ELECTROACOUSTIC TRANSDUCER, AND ASSOCIATED ASSEMBLY AND SYSTEM

The present invention relates to the field of the electroacoustic transducers. It relates more particularly to an electroacoustic transducer capable of converting an airborne acoustic signal into an electrical signal.

BACKGROUND OF THE INVENTION

Such an electroacoustic sensor can implement various transduction technologies. It can in particular be of the capacitive, piezoresistive, piezoelectric, electrodynamic or optical type. Generally, such an electroacoustic transducer comprises a mobile element (such as a deformable membrane, or a suspended or deformable plate, or also a flexible strip) the movement of which, caused by an acoustic wave, is transformed into an electrical variable, which is the image of the acoustic pressure, by a transduction element.

A piezoresistive electroacoustic sensor utilizes piezoresistive gauges placed in the zones of maximum stresses of a membrane constituting the mobile element.

A piezoelectric electroacoustic sensor utilizes a piezoelectric covering placed over a membrane constituting the mobile element and electrodes configured in order to characterize the stresses in the membrane.

An electrodynamic electroacoustic sensor utilizes a coil and magnets in order to perform a measurement of the current when the coil borne by the mobile element is displaced in a fixed magnetic field.

An optical electroacoustic sensor utilizes an optical measurement of the displacement of the mobile element.

The capacitive detection is that which offers the greatest sensitivity to the small displacements of the mobile element, and thus constitutes the technology that is preferentially, but not necessarily, implemented in the invention.

An electroacoustic sensor with a capacitive effect, also called an electrostatic transducer, comprises a mobile electrode positioned opposite a fixed rear electrode. The mobile electrode is generally constituted by a deformable membrane covered with a conductive layer. The mobile electrode can also be constituted by a conductive plate, or according to other known configurations.

The mobile electrode and the fixed electrode thus form the armatures of a capacitor, charged by a direct voltage. An acoustic pressure exerted on the mobile electrode causes its displacement with respect to the rear electrode, generally by deformation of the membrane which constitutes it. This leads to a variation in the capacitance formed between the mobile electrode and the fixed rear electrode.

As the electric charge of the capacitor thus constituted is held constant and equal to the product of the voltage and the capacitance, the variation in the capacitance produces an inverse variation in voltage.

In the known state of the art, this type of sensor corresponds to a microphone technology. Microphones are configured so that over their bandwidth they have the most constant sensitivity possible. Their bandwidth extends as widely as possible over a band situated between approximately 20 Hz and approximately 20 kHz, which correspond to the whole of the audible spectrum.

In a capacitive electroacoustic transducer, the coupled system constituted by the mobile electrode, a dissipative element (i.e. capable of causing a dissipation of energy), and typically capable of being an air space situated between the mobile electrode and the fixed electrode, and a cavity, has a natural frequency, which corresponds to a resonance frequency of the electroacoustic transducer in a natural resonance mode. This is the case for any capacitive electroacoustic transducer. In the case of a capacitive electroacoustic transducer the mobile electrode of which is a deformable membrane, the resonance frequency can be defined—to a certain extent—by adjusting the strain of the membrane.

A sensitivity which is the most constant possible over the bandwidth for which the microphone is configured is obtained on the one hand, by configuring the transducer in order to move its first resonance frequency beyond the bandwidth used, and on the other hand by damping this resonance.

Typically, for a microphone, it is standard practice to shift this resonance frequency towards the high frequencies, for example beyond 9 KHz or more depending on the applications: up to 140 kHz for microphones intended for measurements on models (in order to retain a wavelength on the scale of the model, a frequency must consequently be used that is shifted towards the high frequencies), even up to 0.5 MHz for the study of shock waves or animals emitting ultrasound such as for example bats. As regards obtaining a damping which allows the attenuation of the resonance peak in the main mode or in other modes which can be situated within the bandwidth used, the presence of a film of air between the membrane and the electrode induces a damping caused by the viscous losses in air. This acoustic resistance will influence the quality factor, which is a predominant parameter for the characterization of the behaviour of the electroacoustic transducer. The quality factor is a dimensionless parameter which characterizes the damping factor of an oscillating system.

The quality factor can be measured or calculated in various known ways. It is defined as the ratio of the natural frequency, at which the gain is maximum, to the width of the bandwidth of the system at −3 dB of the resonance level.

The higher the quality factor, the lower the bandwidth, and the more the resonance is indicated by a significant gain peak, i.e. high and narrow.

Thus, an electroacoustic transducer must have a low quality factor, indicating the absence of a significant resonance peak.

There are multiple applications for an electroacoustic transducer operating as a sensor. In certain applications, it is advisable to determine whether the electroacoustic transducer is exposed to a given frequency or not.

To this end, it is known to use a selective electronic filter of the frequency considered, or of the range of frequencies considered. Such a filter nevertheless leads to a certain complexity of implementation, requiring a certain computing power (in the case of a digital filter), and requires an electrical supply which also makes implementation of the system more complex. This complexity is detrimental, in particular in the systems implementing electroacoustic transducers which are small in size and/or in large numbers. A large number of electroacoustic transducers used as sensors can in fact be necessary in order to discriminate several frequencies or ranges of frequencies, and/or in order to determine the exposure to certain frequencies in an extended space, which requires the sensors to be dispersed.

A purpose of the present invention is to resolve at least one of the aforementioned drawbacks.

SUMMARY OF THE INVENTION

In particular, the invention relates to an acoustic transducer capable of converting an acoustic signal into an electrical signal, comprising an element that is mobile under the effect of said acoustic signal, a fixed element arranged opposite the mobile element, a cavity, and a dissipative element interposed between the mobile element and the fixed element, the coupled system constituted by the mobile element, the dissipative element and the cavity having a natural frequency corresponding to a resonance frequency of the transducer at which its sensitivity is at a maximum, in which the mobile element, the fixed element, the dissipative element and the cavity are configured such that the quality factor of the acoustic transducer is greater than two. The cavity has a straight prismatic or cylindrical or frustoconical general shape, the mobile element forming a first base of the prism, cylinder or frustum, the fixed element being arranged inside said prism, cylinder or frustum, raised with respect to the second base of the prism, cylinder or frustum.

A quality factor greater than two characterizes a filter that is selective around the natural frequency of the mobile electrode. Thus, contrary to a device such as those known in the state of the art, filtering of the acoustic signal received is carried out directly at the level of the electroacoustic transducer used as sensor, in an analogue manner, without requiring the use of additional digital means. This results in a great ease of implementation, a low electrical consumption of the assembly, and the absence of additional computational resources.

Preferably the fixed element has a smaller surface area than the surface area of the mobile element. In a variant, the ratio between the surface area of the mobile element and that of the fixed element is less than or equal to 1/6. In particular, the ratio between the surface area of the mobile element and that of the fixed element is less than or equal to 1/12.

The dissipative element can be constituted by a gas or a mixture of gases. For example, the dissipative element can be constituted by air.

In an embodiment, the mobile element and the fixed element are circular.

The cavity can in particular have a generally rotationally symmetrical cylindrical shape.

The coupled system constituted by the mobile electrode, the dissipative element and the cavity can be configured so that its natural frequency is comprised between 20 Hz and 20 KHz. This is the case in the preferred applications of the invention, but a transducer according to certain embodiments of the invention can have a resonance frequency in certain ultrasound or infrasound ranges. The transducer can for example be configured so as to have a maximum frequency sensitivity situated between 20 kHz and 140 KHz. The transducer can for example be configured so as to have a maximum frequency sensitivity of the order of 500 KHz.

In a preferred embodiment the transducer is capacitive. In this case, the mobile element is a mobile electrode, the fixed element is a fixed electrode. The mobile electrode can comprise a deformable membrane.

The capacitive transducer according to an embodiment of the invention can be configured so that the exposure of the mobile electrode to a sound wave with a frequency corresponding to the resonance frequency of the transducer causes contact between the mobile electrode and the fixed electrode, so that the transducer forms a switch.

The transducer can moreover comprise a device for balancing the static pressure prevailing on either side of the mobile element. Such a device for balancing the static pressure can comprise a capillary tube. The device for balancing the static pressure can comprise several capillary tubes.

BRIEF DESCRIPTION OF THE DRAWINGS

Other features and advantages of the invention will become more apparent in the description hereinafter.

In the attached drawings, given as non limitative examples.

DETAILED DESCRIPTION OF THE PREFERRED EMBODIMENTS

Figure 1:
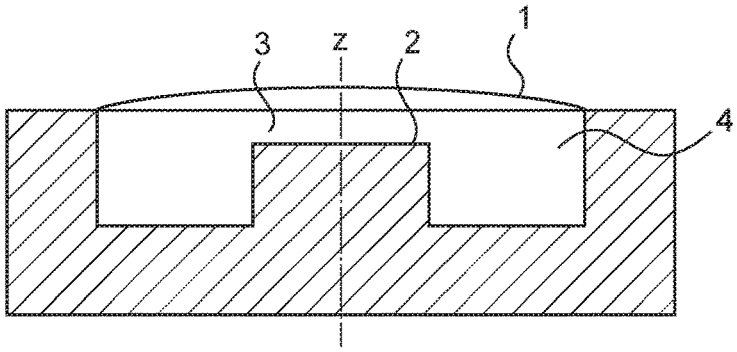
FIG. 1 diagrammatically shows an electroacoustic transducer according to an embodiment of the invention.

FIG. 1 diagrammatically shows a transducer according to an embodiment of the invention, in a cross section view. In the embodiment shown here by way of example, the electroacoustic transducer is rotationally symmetrical about a main axis z.

An electroacoustic capacitive transducer as shown comprises a mobile electrode 1 constituting a mobile element. In the embodiment shown here, the mobile electrode 1 is a deformable membrane constituting an electrical conductor (or comprising an electrically conductive covering). A fixed electrode 2, constituting a fixed element, is arranged opposite the mobile electrode 1. An air space between the mobile electrode 1 and the fixed electrode 2 constitutes a dissipative element 3. The dissipative element is also resistive. The dissipative element 3 causes an effect of viscous damping of the movement of the mobile element. In other embodiments, not shown, other dissipative fluids can be used, such as another gas or mixture of gases, or a layer of polymer. The electroacoustic transducer comprises moreover a cavity 4, having an annular shape in the example shown due to the particular configuration of the transducer. In the example shown here, the cavity thus has a general shape of a cylinder of revolution. The mobile electrode 1 and the fixed electrode 2 form the armatures of a capacitor, polarized by a direct voltage. When an acoustic pressure is exerted on the mobile electrode 1, the latter is displaced with respect to the fixed electrode. In the example shown here, this movement corresponds to a deformation of the membrane forming mobile electrode 1. This leads to a variation in the capacitance formed between the membrane and the fixed electrode, which produces an inverse variation in the voltage.

In an electroacoustic transducer according to the invention, the mobile electrode 1, the fixed electrode 2, the dissipative element 3 and the cavity 4 are configured so that the quality factor of the acoustic transducer is greater than two.

Such a transducer, used as a sensor, allows, in an application of the invention, the detection of a localized acoustic field having as frequency that defined by the resonance frequency of the coupled system constituted by the mobile electrode, the air space between the latter and the rear electrode and the cavity. An electroacoustic transducer having a high quality factor, typically greater than two, is called resonant.

It is possible to obtain a high quality factor by suitable choice of the various parameters defining the aforementioned elements constituting the transducer (the mobile electrode 1, the fixed electrode 2, the dissipative element 3 and the cavity 4). The choice of these parameters influencing the behaviour of the transducer aims in particular to limit the damping of the system, without reducing the acoustic sensitivity of the transducer. The damping in such device is caused by the viscous shearing of the air space (or suitable dissipative element 3) situated below the membrane (or other mobile electrode 1).

Among the parameters influencing the quality factor, the ratio between the surface area of the mobile electrode 1, i.e. typically the surface area exposed to the sound waves, for example the surface area of the membrane capable of deforming under the effect of waves received, and the surface area of the fixed electrode 2, is predominant. A resonant capacitive electroacoustic transducer, typically characterized by a quality factor greater than 1.5 and preferably greater than 2, is generally obtained by using a fixed electrode 2 having a surface area less than 1/6 of the surface area of the mobile electrode 1. For a circular membrane and a fixed electrode 2 that is also circular, such as in the embodiment example shown here, the ratio of the radius of the fixed electrode 2 to the radius of the membrane is thus preferentially chosen to be less than 2/5, corresponding to a surface area ratio of 4/25, i.e. approximately 1/6.

The reduction of the surface area of the fixed electrode 2 with respect to that of the mobile electrode 1 leads to a reduction in the damping by viscous friction within the dissipative element 3 (for example the air space) situated between these two electrodes, when the movement of the mobile electrode 1 drives the dissipative element towards the cavity 4, which can in particular be a rear or peripheral cavity. The reduction in the space between the mobile electrode 1 and the fixed electrode 2 (also called inter-electrode space) allows the sensitivity of the transducer to be maintained without notably increasing the viscous damping. For electrodes (fixed and mobile) with the same surface area, the spacing of the electrodes making it possible to significantly reduce the viscous damping causes a drop in the static capacitance of the transducer, which is indicated by a significant reduction in its sensitivity.

The surface area ratio mentioned above can be generalized to numerous shapes of membranes and of the fixed electrode 2. As an alternative to a circular membrane, a square, polygonal, oval membrane, etc., can be used as mobile electrode 1. As an alternative to a circular electrode, a square, polygonal, oval electrode, etc., can be used as fixed electrode 2. All the combinations of the aforementioned shapes of membrane (or more generally mobile electrode 1) and fixed electrode 2 can be used in the invention, in particular with a surface area ratio as expressed above. In fact, by way of example, the deflected curve of a square membrane is expressed by a product of cosines, and the deformed shape of a circular membrane according to a Bessel function. For the first method, and apart from the corners of the square membrane, the series expansion of their deformed shape functions are identical up to the second order.

Of course, numerous other parameters determining the configuration of the transducer have an influence on the damping of the system, this maximum ratio of surface area can be substantially exceeded if the other parameters confer a very low damping on the system, and this surface area ratio must in any case be adopted in combination with of other parameters conferring a suitable weak damping on the system.

The damping of the system is directly linked to the dissipative element interposed between the mobile membrane and the fixed membrane and to its viscosity. In particular, the thickness of the viscous boundary layer of the dissipative element 3 (generally air) is significant, so that the clearance between the mobile electrode 1 and the fixed electrode 2 constitutes a significant parameter for configuration of the electroacoustic transducer. Thus, in order to limit the damping so as to maximize the quality factor, the thickness of the dissipative element (for example the layer of air) between the mobile electrode 1 and the fixed electrode 2 can be increased.

Among the set of configuration parameters influencing the quality factor of the system, there may be mentioned:

- For the definition of the mobile element, it is a membrane: its dimensions—typically its surface area or its radius if it is circular—, its thickness, the material constituting its substrate and the conductive covering that it bears, its (mechanical) strain at rest;
- For the definition of the fixed electrode: its dimensions—typically its surface area or its radius if it is circular—, its position in the transducer;
- For the definition of the dissipative element: the material of which it is constituted, its thickness, its pressure and its temperature if it is a gas;
- For the definition of the cavity: its general shape and its dimensions,
- For the assembly: the general configuration, in particular the position and the orientation of the aforementioned elements, the polarization voltage of the capacitor thus formed (in the case of a capacitive transducer).

Of course, according to different embodiments of the invention, the parameters to be defined can vary. In particular, the mobile element can be for example an embedded flexure plate, a suspended rigid plate or a flexible strip embedded at one of its ends (the movement of the other end being characterized). In this case, the parameters defined are in particular those that define the mechanical properties of the mobile element.

In order to make it possible to obtain a configuration suitable for obtaining a maximum gain at the desired frequency, a preferred geometry of the invention, as represented in FIG. 1, comprises an annular cavity 4 defined by a cylinder of revolution inside of which the fixed electrode is positioned raised with respect to one of the bases of the cylinder. The height at which the fixed electrode 2 is raised makes it possible to adjust the clearance between said fixed electrode 2 and the membrane in order to obtain the weak damping desired without however limiting the sensitivity too much.

Although described according to a preferred embodiment shown in FIG. 1, numerous variants can be envisaged without exceeding the scope of the invention. In particular, the cavity 4, previously described in an embodiment in which it is a cylinder of revolution, can however have another general shape, in particular straight prismatic with a square or rectangular base. The membrane can have a corresponding shape (square, rectangular, etc.) in particular in the case where it is fabricated from a silicon wafer by anisotropic chemical etching.

The membrane can alternatively and non-limitatively be constituted by a flexure plate, a flexible strip or a rigid plate suspended by flexure arms, provided that cut outs allowing movement of the arm do not constitute an acoustic short-circuit between the front face of the sensor and the air space or other dissipative element at the rear of the plate.

The electroacoustic transducer can advantageously comprise a device balancing the static pressure, i.e. the atmospheric pressure on either side of the mobile element. This device can comprise one or more capillary tubes.

This device for balancing the static pressure allows the acoustic sensor to operate as a differential sensor. In fact, as the static (atmospheric) pressure is balanced on either side of the mobile element (typically the membrane), the static mechanical strain of the membrane, which influences the sensitivity of the sensor, remains constant. The sensor thus obtained is therefore only sensitive to a differential at a dynamic pressure, the dimensioning of the capillary tube(s) being such that they act as an infinite impedance preventing the dynamic pressure from penetrating to the rear of the mobile element, typically in the cavity of the transducer.

Moreover, the geometry described previously, in which the fixed element is arranged inside the cavity raised on one of its bases, is advantageously applicable to any transducer technology. Typically, for a piezoelectric, piezoresistive, electrodynamic or optical sensor, the mobile element (for example a membrane) is positioned opposite a contact arranged raised in the cavity, as described previously for the fixed electrode of a capacitive transducer.

Numerous embodiment variants can be envisaged without exceeding the scope defined in the invention. Typically, depending on the embodiment considered, the material constituting the mobile part can be silicon, a polymer, metal, or any other suitable material. The predominant parameter which determines the behaviour of the mobile element is its mass per unit area, which results from the product density times its thickness (if this is constant).

In the case of the use of silicon, it is possible by Deep Reactive Ion Etching or "DRIE" to produce numerous shapes of membrane and fixed electrode (if the sensor is capacitive). However, if a process of anisotropic chemical etching in an aqueous bath is used, the shape obtained depends on the crystallographic orientation of the silicon wafer and on the orientation of the patterns on this wafer with respect to the crystallographic reference. The shapes obtained for masks that are initially square or round can also be as varied as cylinders or cones with square, octagonal or hexagonal bases, or other shapes depending on the orientation of the pattern on the silicon wafer and the orientation of the latter with respect to the crystallographic reference.

In the case of fabrication from a metal or a polymer, it is generally possible to produce the desired shape, under the same conditions and fabrication tolerances.

Figure 2:
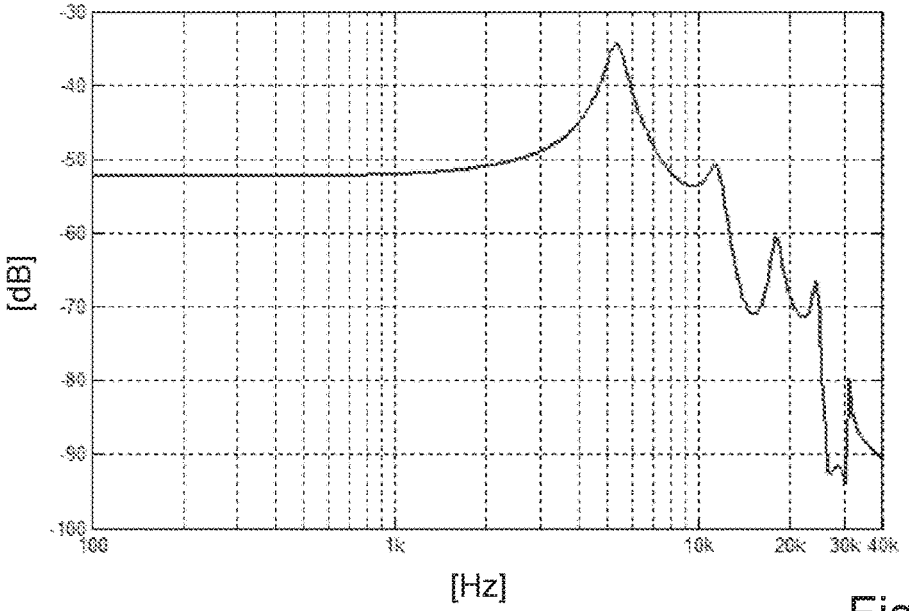
FIG. 2 diagrammatically shows on a graph the behaviour of an electroacoustic transducer according to a first configuration of the embodiment of FIG. 1.

FIG. 2 shows a first example of the behaviour of an electrostatic transducer according to an embodiment of the invention, and configured according to a first configuration.

The sensitivity of the transducer in decibels (dB) referenced at 1 V/Pa is shown on the y-axis, the frequency in hertz (Hz) is shown on the x-axis.

The general geometry of the transducer corresponds to the embodiment shown in FIG. 1. The main parameters of this first example of configuration are the following. The membrane is circular with a radius of 2.5 mm, a thickness of 50 microns and a density of 4000 $kg \cdot m^{-3}$. The membrane tension is 213 $N \cdot m^{-1}$. The fixed electrode has a radius of 0.6 mm. The clearance between the membrane and the fixed electrode is 13 microns. The annular cavity has a depth of 4 mm. The polarization voltage is 5 V.

The resonance frequency of the transducer for which the sensitivity is maximum is approximately 5300 Hz. The quality factor of the transducer is approximately 7, which guarantees good selectivity as a sensor. This is indicated by a high and narrow sensitivity peak around the resonance frequency of the transducer.

Figure 3:
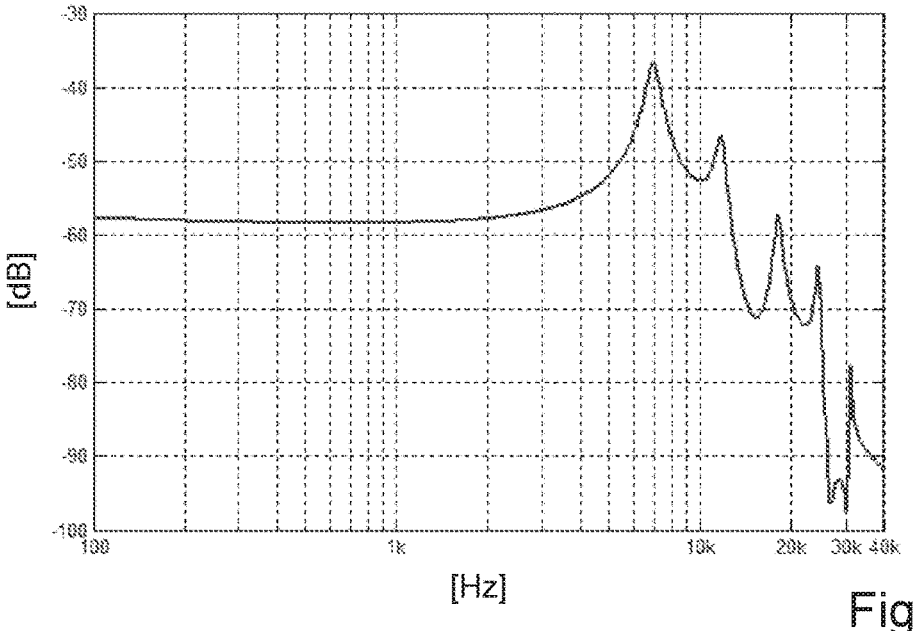
FIG. 3 diagrammatically shows on a graph similar to FIG. 2 the behaviour of an electroacoustic transducer according to a second configuration of the embodiment of FIG. 1.

FIG. 3 diagrammatically shows on a graph similar to FIG. 2 the behaviour of an electroacoustic transducer according to a second configuration of the embodiment of FIG. 1. The scales used are similar to those of FIG. 2.

The general geometry of the transducer corresponds to the embodiment shown in FIG. 1. The main parameters of this second example of configuration are the following. The membrane is circular with a radius of 2.5 mm, a thickness of 50 microns and a density of 4000 $kg \cdot m^{-3}$. The membrane tension is 213 $N \cdot m^{-1}$. The fixed electrode has a radius of 0.6 mm. The distance between the membrane and the fixed electrode is 15 microns. The annular cavity has a depth of 4 mm. The polarization voltage is 5 V.

The resonance frequency of the transducer for which the sensitivity is maximum is approximately 7000 Hz. The quality factor of the transducer is approximately 10, which guarantees good selectivity as a sensor. This is indicated by a high and narrow sensitivity peak around the resonance frequency of the transducer. This figure nevertheless shows the fact that resonance modes can be close to the main mode. In this case, in order to obtain a selective filter around the main mode only, it is advisable not to limit the damping of the system too much. Thus, for a given surface area ratio between the membrane and the fixed electrode, a maximum value can exist for the distance between said membrane and said electrode beyond which other resonance modes are not sufficiently attenuated. Thus, if the maximization of the distance between the membrane and the fixed electrode is a general design rule, certain configurations limit this distance due to the requirement of maintaining a sufficient damping which is necessary due to the proximity between the main resonance mode and other modes.

Figure 4:
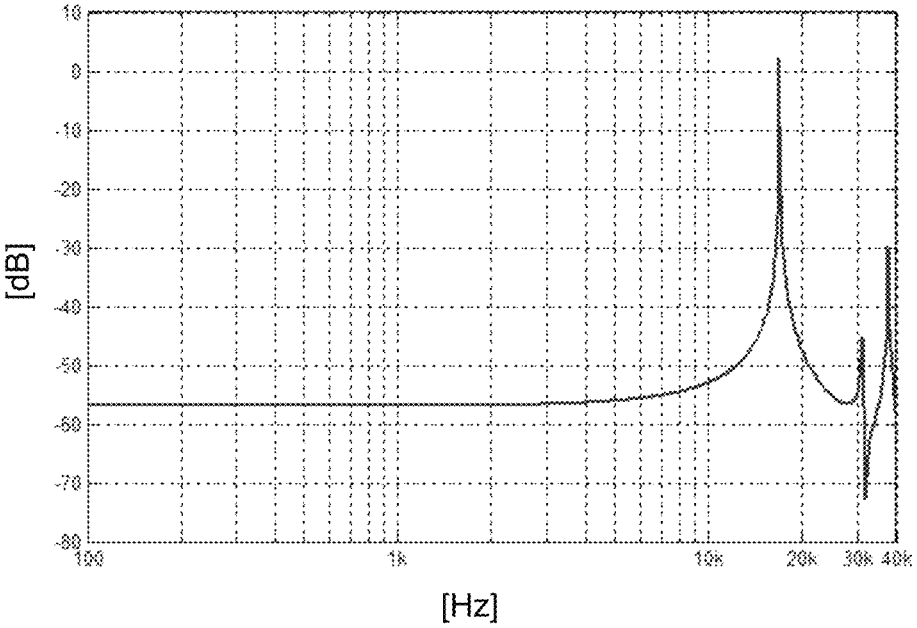
FIG. 4 diagrammatically shows on a graph similar to FIGS. 2 and 3 the behaviour of an electroacoustic transducer according to a third configuration of the embodiment of FIG. 1.

FIG. 4 diagrammatically shows on a graph similar to FIGS. 2 and 3 the behaviour of an electroacoustic transducer according to a third configuration of the embodiment of FIG. 1.

The scales used are similar to those of FIG. 1 and FIG. 2.

The general geometry of the transducer corresponds to the embodiment shown in FIG. 1. The main parameters of this third example of configuration are the following. The membrane is circular with a radius of 6.5 mm, a thickness of 25 microns and a density of 1420 $kg \cdot m^{-3}$. The membrane tension is 2621 $N \cdot m^{-1}$. The fixed electrode has a radius of 0.1 mm. The distance between the membrane and the fixed electrode is 5 microns. The annular cavity has a depth of 2 mm. The polarization voltage is 2 V.

The resonance frequency of the transducer for which the sensitivity is maximum is approximately 16800 Hz. The quality factor of the transducer is approximately 805. This guarantees extreme selectivity as a sensor of the targeted frequency. This is indicated by a high and extremely narrow sensitivity peak around the resonance frequency of the transducer.

Moreover, it is noted that the significant reduction in the radius of the fixed electrode implies a reduction in the inter-electrode space (distance between the membrane and the fixed electrode), which makes it possible to maintain the value of the static capacitance of the transducer. This can nevertheless, in the case of a capacitive transducer, cause phenomena of collapse of the membrane (also denoted by the expression "pull-in") which correspond to a maximum deflection of the membrane which continues until contact is made with the rear electrode. It is then necessary of reduce the polarization voltage of the transducer to a very low level (often denoted "V_pull_out") in order to release the latter. This phenomenon, which must generally be avoided, can however be taken advantage of in the case where the transducer is no longer used as a variable capacitance but as a switch activated by a sound wave of given frequency (in this case the resonance frequency of the transducer).

The examples presented above show resonant transducers the resonance frequency of which is situated between 5000 Hz and approximately 17000 Hz. The preferential application of the invention is in the range of the audible frequencies, i.e. from approximately 20 Hz to approximately 20 KHz, and preferably above 1 KHz.

In addition, the invention can also be applied in the field of ultrasound. The invention can also be applied in certain ranges of infrasound, but a weak tension of the membrane is generally a parameter opposed to obtaining a resonant capacitive transducer, so that a high quality factor is particularly difficult to achieve in the low frequencies.

Thanks to the frequency filtering carried out by a transducer having a high quality factor, the transducer can be used successfully including in noisy surroundings. Due to the great simplicity of implementation of such a system, and the absence of electronic filtering and the electricity consumption associated with each transducer, it is possible to easily multiply the number of transducers utilized, in particular in a large space and/or for capturing several predefined frequencies.

Thus, by adopting a design contrary to that sought for traditional microphones, the bandwidth of which must be as wide as possible within the range of the audible frequencies, the invention developed here proposes the design of an electroacoustic transducer the resonance of which is weakly attenuated so that it acts as a selective frequency filter. This is indicated by a high quality factor that is unknown in the field of microphones, typically greater than two.

The invention claimed is:

1. An acoustic transducer that converts an acoustic signal into an electrical signal, comprising:

a mobile element that is mobile under the effect of said acoustic signal;

a fixed element arranged opposite the mobile element;

a cavity (4); and a dissipative element (3) interposed between the mobile element and the fixed element, wherein a coupled system, constituted by the mobile element, the dissipative element (3), and the cavity (4), has a natural frequency between 20 Hz and 20 KHz corresponding to a resonance frequency of the transducer at which a sensitivity of the transducer is maximum, the mobile element, the fixed element, the dissipative element (3) and the cavity (4) being configured so that a quality factor of the acoustic transducer is greater than two, wherein the cavity (4) has one of a straight prismatic, cylindrical, or frustoconical general shape, the mobile element forming a first base of the prism, cylinder or frustum, the fixed element being arranged inside said prism, cylinder or frustum, raised with respect to a second base of the prism, cylinder or frustum, and wherein a ratio between the surface area of the mobile element and that of the fixed element is less than or equal to ⅙.

2. The transducer according to claim 1, wherein the ratio between the surface area of the mobile element and that of the fixed element is less than or equal to 1/12.

3. The transducer according to claim 2, wherein the mobile element and the fixed element are circular.

4. The transducer according to claim 1, wherein the dissipative element (3) is constituted by a gas or a mixture of gases.

5. The transducer according to claim 4, wherein the dissipative element (3) is constituted by air.

6. The transducer according to claim 5, wherein the mobile element and the fixed element are circular.

7. The transducer according to claim 4, wherein the mobile element and the fixed element are circular.

8. The transducer according to claim 1, wherein the mobile element and the fixed element are circular.

9. The transducer according to claim 1, wherein the cavity (4) has a generally rotationally symmetrical shape.

10. The transducer according to claim 1, the mobile element being a mobile electrode (1), the fixed element being a fixed electrode (2), the transducer being a capacitive transducer.

11. The transducer according to claim 9, wherein the mobile electrode (1) comprises a deformable membrane.

12. The transducer according to claim 10, configured so that that exposure of the mobile electrode (1) to a sound wave with a frequency corresponding to the resonance frequency of the transducer causes contact between the mobile electrode (1) and the fixed electrode (2) so that that the transducer forms a switch.

13. The transducer according to claim 1, further comprising:

a device for balancing a static pressure prevailing on either side of the mobile element.

14. The transducer according to claim 13, wherein the device for balancing the static pressure comprises a capillary tube.

* * * * *